United States Patent [19]

Weber

[11] Patent Number: 4,881,646

[45] Date of Patent: Nov. 21, 1989

[54] ISOTHERMAL PACKAGE MATERIAL

[76] Inventor: Jean-Pierre Weber, Avenue Gasparin 14, CH-1224 Chene Bougeries, Switzerland

[21] Appl. No.: 610,994

[22] PCT Filed: Aug. 30, 1982

[86] PCT No.: PCT/CH82/00103

§ 371 Date: Apr. 27, 1984

§ 102(e) Date: Apr. 27, 1984

[87] PCT Pub. No.: WO84/00943

PCT Pub. Date: Mar. 15, 1984

[51] Int. Cl.[4] ..... B65D 85/45

[52] U.S. Cl. ..... 206/460; 229/87 R; 206/521

[58] Field of Search ..... 206/460, 494, 439, 521; 229/40, 87 R, 89, 91

[56] References Cited

U.S. PATENT DOCUMENTS

| | | | |
|---|---|---|---|
| 492,306 | 2/1893 | Meech | 229/91 |
| 2,127,029 | 8/1938 | Hermanson | 229/91 |
| 2,502,749 | 4/1950 | Reid | 229/87 R |
| 2,553,923 | 5/1951 | Lambert | 229/87 R |
| 2,954,912 | 10/1960 | Kauffeld | 229/3.5 MF |
| 3,038,811 | 6/1962 | Reading | 206/439 |
| 3,203,618 | 8/1965 | Andrews et al. | 229/40 |
| 3,291,377 | 12/1966 | Eggen | 206/390 |
| 3,314,211 | 4/1967 | Wolff | 229/87 R |
| 3,366,313 | 1/1968 | Culberg et al. | 229/87 R |
| 3,597,302 | 8/1971 | Gerard | 229/87 R |

*Primary Examiner*—Joseph Man-Fu Moy
*Attorney, Agent, or Firm*—Robert E. Burns

[57] ABSTRACT

Sheet material for making a sealed isothermal package comprises a flexible outer sheet of polyvinyl having a shiny reflective outer surface. The entire inner surface of the outer sheet is coated with pressure sensitive adhesive. An inner heat insulating layer of plastic foam is bonded to the inner side of the outer sheet by the adhesive. The inner insulating layer is of lesser area than the outer sheet so as to leave marginal areas of the adhesive surface of the outer sheet exposed for adhesion to underlying portions of the sheet material when the sheet material is wrapped around an object to be packaged. The insulating layer is of sufficient thickness that when the sheet material is wound in a roll, the exposed adhesive marginal areas are spaced apart so that no release backing material is required.

7 Claims, 2 Drawing Sheets

ISOTHERMAL PACKAGE MATERIAL

This invention relates to an isothermal packaging material for fresh or deep-frozen products, especially foodstuffs, pharmaceuticals and vegetable products.

Every day, millions of people are faced with the problem of carrying products whose quality, flavour or appearance deteriorates rapidly if they are not kept below or above certain temperatures.

The critical temperature varies very widely depending on the nature of the products. By way of example, it is +8° C. for butter and cheese, +13° C. for meat and fish, about +42° C. for ready-cooked or prepared foods intended to be eaten hot (roast chicken, hot ham, etc.), −8° C. for deep-frozen foods, this being the temperature above which the products may not be re-frozen without risk to the consumers' health, about +18° C. for some pharmaceuticals (suppositories, etc.), about +20° C. for flowers and plants, etc., etc.

It is possible with the material of the invention to package these products and keep them for a fairly long period at a temperature which only very slowly approaches ambient temperature and their critical temperatures. It thus makes it possible to preserve these products for several hours (from 2 to 12, depending on the circumstances) at a temperature at which they are suitable for consumption or use. This period of time is at least long enough to cover the normal transport period. This material is characterised by the fact that it consists of a flexible sheet with one highly reflective surface and comprises at least one layer of material of low heat conductivity, e.g. plastic foam or unwoven textile fibres. The package is obtained by wrapping the sheet once or several times around the product to be preserved, with the reflective side outwards, and then closing the package by independent or specially designed means by fastening together the juxtaposed parts of the longitudinal edges and applying the free transverse edge against the body of the package.

The package thus obtained is cheap, occupies very little space, is unbreakable, re-usable and in addition affords good shock protection.

The attached drawings illustrate diagrammatically and by way of example an embodiment of the object of the invention.

Figure 1:
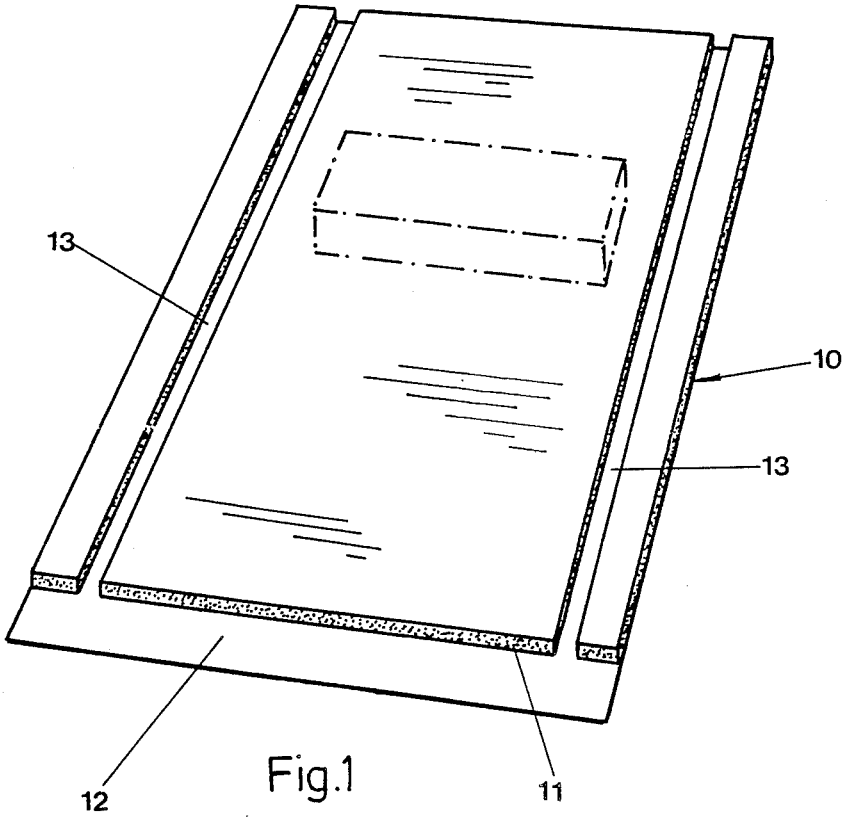
FIG. 1 is a perspective view of the package ready for use.

The isothermal packaging material shown in the drawing consists of a flexible rectangular sheet 10 of polyvinyl, 40 cm wide, 90 cm long and 0.5 mm thick, which is white and shiny on its outer surface and self-adhesive on the inner, and a layer of open-celled plastic foam 11, 5 mm thick, adhesively secured to the inner surface of the sheet.

This layer 11 is discontinuous in order to reveal the self-adhesive surface of sheet 10 along a transverse section 12 and along two longitudinal strips 13.

Figure 2:
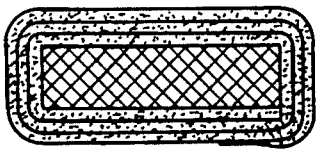
FIGS. 2 and 3 are cross-sections through a package made by means of this embodiment in perpendicular planes.
Figure 3:
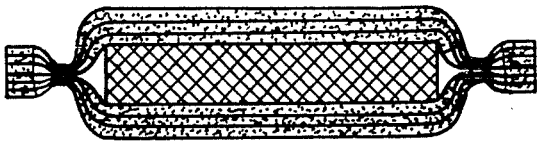
Figure 5:
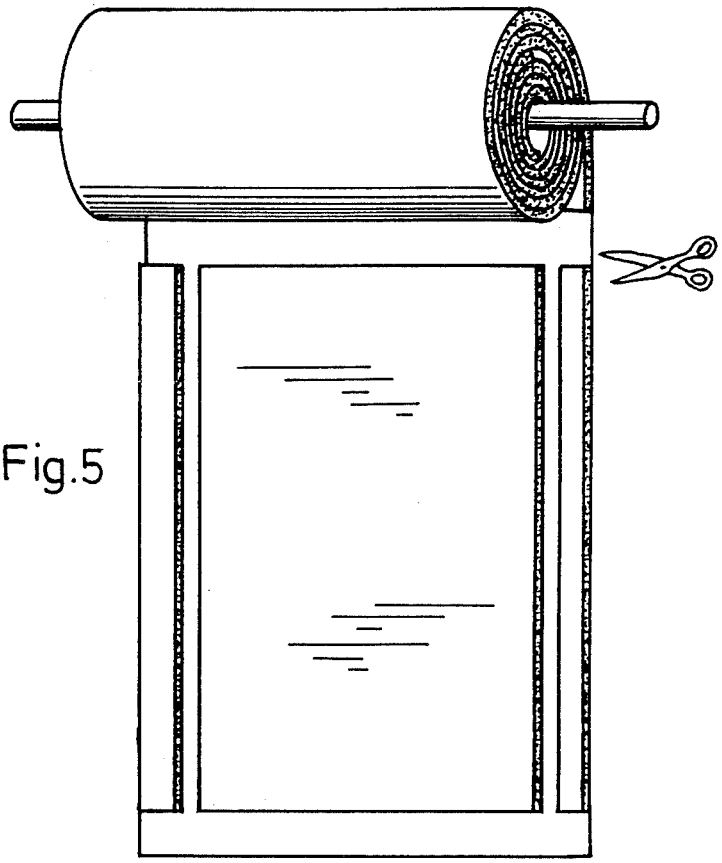
FIG. 5 illustrates the mass production and storage of the material.

FIGS. 2 and 3 show how the sheet illustrated in FIG. 1 is used to wrap a 400 g block of ice cream.

The sheet is wrapped three times around the block and the package thus obtained is closed by pressing self-adhesive strips 12 and 13 against the corresponding surfaces of the shiny side of sheet 10.

Figure 4:
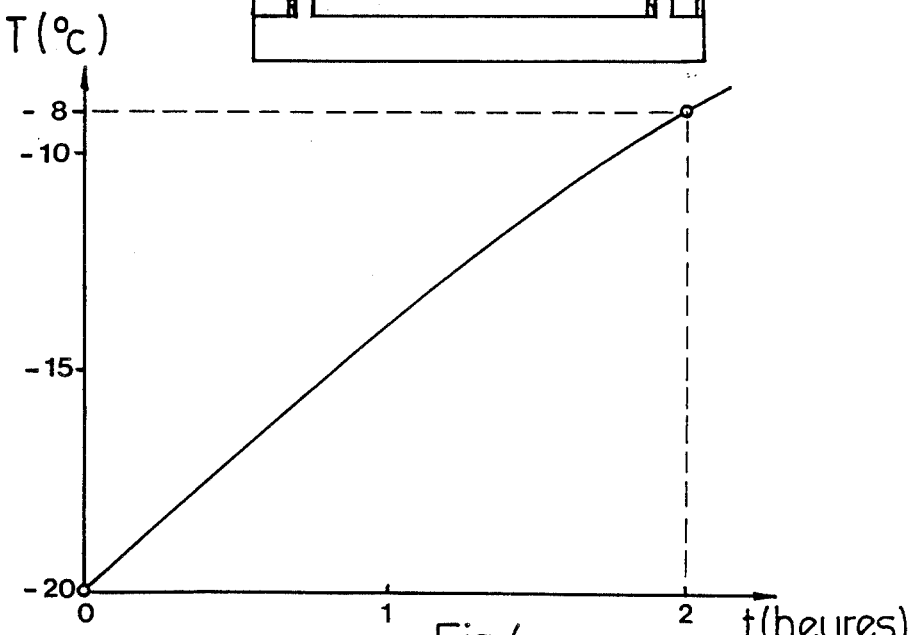
FIG. 4 is a graph showing the temperature of the packed product as a function of time.

This package, placed in an environment with an ambient temperature of +22° C., is capable of keeping the block of ice cream, initially at a temperature of −20° C., cool for about 2 hours before it reaches the temperature of −8° C. at which it begins to melt (FIG. 4). The package thus gives a much better performance than the aluminium carriers or bags found in supermarkets, which will keep the same block in the same conditions for hardly an hour.

Sheets as shown in FIG. 1 will best be continuously mass-produced, stored on rolls and used as required by cutting the sheets off one after the other.

The packaging material shown in the drawing is more especially intended for pre-packed products. In a variant intended for non-pre-packed products, particularly meat, it is possible to provide an additional inner layer partly covering the foam, which may, for instance, be aluminium foil, PVC film or greaseproof paper, to protect the product and prevent it from leaking into the foam. This additional layer may be adhesively secured to the layer of foam solely along one edge in order to prevent crumpling.

In another variant, the flexible sheet may comprise an area without adhesive contiguous to strip 12 to provide a grip on the edge for the purposes of opening the package.

It will be noted that the seal and the heat insulation of the edges of the package are reinforced by the continuous adhesion area constituted by strips 12 and 13 and by the pressure exerted on the foam in this area.

It will be also noted that, when the sheets are stored in rolls, the self-adhesive strips 12 and 13 are in contact with neither the air nor the foam and are therefore always clean and usable.

The packages may be closed by other means than self-adhesive surfaces, e.g. by clips, clamps, pressure, string, elastic bands or nets, etc. The package may also be closed at the sides like conventional packages by folding the sides beneath the body of the package.

I claim:

1. Sheet material for making a sealed isothermal package comprising:

a flexible sheet having a highly reflective outer surface and a self-adhesive inner surface, and a flexible insulating layer of low heat conductivity material bonded to said flexible sheet by said self-adhesive inner surface, said insulating layer being of lesser area than said flexible sheet and leaving marginal areas of said self-adhesive inner surface of said flexible sheet exposed for adhesion to an underlying portion of said sheet material when wrapped around an object to be package to seal the package.

2. Sheet material according to claim 1 in which said flexible sheet is of polyvinyl having a white shiny outer surface and self-adhesive inner surface.

3. Sheet material according to claim 1, in which said insulating layer is open-cell plastic foam.

4. Sheet material according to claim 1, in which said sheet material is wound in a roll, said insulating layer being of sufficient thickness that exposed areas of said self-adhesive surface of said flexible sheet are spaced by said insulating layer from underlying convolutions of said sheet material to prevent adhesion to said underlying convolutions without a release backing sheet.

5. A sealed isothermal package of an object, comprising sheet material wrapped around the object with an overlap said sheet material comprising, a flexible sheet having a highly reflective outer surface and a self-adhesive inner surface, and a flexible insulating layer of low heat conductivity material bonded to said flexible sheet by said self-adhesive inner surface, said insulating layer being of lesser area than said flexible sheet and leaving marginal areas of said self-adhesive inner surface of said flexible sheet exposed, said marginal areas of said self-adhesive inner surface of said flexible sheet being adhered to contiguous portions of said sheet material to seal the package.

6. A package according to claim 5, in which said flexible sheet is a plastic sheet having a shiny outer surface and a self-adhesive inner surface, and said insulating layer is open-cell plastic foam.

7. A package according to claim 5, in which said sheet material is wrapped a plurality of times around said object to form a multi-layer package.

* * * * *